US009903382B2

(12) United States Patent
Micheli et al.

(10) Patent No.: US 9,903,382 B2
(45) Date of Patent: Feb. 27, 2018

(54) AXIAL COMPRESSOR FOR FLUID-FLOW MACHINES

(71) Applicant: ANSALDO ENERGIA SWITZERLAND AG, Baden (CH)

(72) Inventors: Marco Micheli, Wettingen (CH); Wolfgang Kappis, Fislisbach (CH); Luis Federico Puerta, Rieden (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 593 days.

(21) Appl. No.: 13/678,602

(22) Filed: Nov. 16, 2012

(65) Prior Publication Data

US 2013/0121807 A1 May 16, 2013

(30) Foreign Application Priority Data

Nov. 16, 2011 (CH) ..... 1833/11

(51) Int. Cl.
*F04D 27/00* (2006.01)
*F04D 19/02* (2006.01)
(Continued)

(52) U.S. Cl.
CPC ..... *F04D 27/009* (2013.01); *F04D 19/028* (2013.01); *F04D 21/00* (2013.01);
(Continued)

(58) Field of Classification Search
CPC .. F04D 27/009; F04D 27/0207; F04D 19/028; F04D 29/685; F04D 29/526;
(Continued)

(56) References Cited

U.S. PATENT DOCUMENTS 2,732,125 A * 1/1956 Ruby ..... F04D 27/0207 415/27
2,830,754 A * 4/1958 Stalker ..... 415/181
(Continued)

FOREIGN PATENT DOCUMENTS

EP 1609999 A2 12/2005
EP 1942259 A2 7/2008

OTHER PUBLICATIONS

European Patent Office, Search Report in Swiss Patent Application No. 1833/11 dated (Feb. 9, 2012).

*Primary Examiner* — Jason Shanske
*Assistant Examiner* — Julian Getachew
(74) *Attorney, Agent, or Firm* — Buchanan Ingersoll & Rooney PC

(57) ABSTRACT

An axial compressor of a fluid-flow machine includes a flow path disposed between a rotor shaft and a relatively stationary housing wall. The flow path extends in an axial direction of the rotor shaft concentrically with the rotor shaft and the housing wall. A plurality of compressor stages are axially arranged in sequence along the flow path in the axial direction. Each of the compressor stages includes a rotor blades row and a guide vane row disposed after the rotor blades row in the axial direction. The flow path and the compressor stages operating therein are penetrable by a mass flow of a fluid to be compressed in a flow direction during operation of the compressor. A return is configured to return a part of the mass flow from a compressor discharge.

14 Claims, 2 Drawing Sheets

(51) Int. Cl.

| | |
|---|---|
| ***F04D 21/00*** | (2006.01) |
| ***F04D 27/02*** | (2006.01) |
| ***F04D 29/52*** | (2006.01) |
| ***F04D 29/56*** | (2006.01) |

(52) U.S. Cl.
CPC ..... *F04D 27/0207* (2013.01); *F04D 29/526* (2013.01); *F04D 29/563* (2013.01)

(58) Field of Classification Search
CPC .... F04D 29/563; F04D 21/00; F04D 27/0215; F04D 27/0223; F04D 27/023; F04D 27/0238
USPC ..... 415/58.5, 58.7, 59.1, 914
See application file for complete search history.

(56) References Cited

U.S. PATENT DOCUMENTS

| | | | | |
|---|---|---|---|---|
| 2,956,732 | A | 10/1960 | Stalker | |
| 3,122,383 | A | 3/1964 | Leis | |
| 4,522,559 | A * | 6/1985 | Burge | F01D 25/26 415/138 |
| 5,340,271 | A * | 8/1994 | Freeman et al. | 415/1 |
| 6,312,221 | B1 * | 11/2001 | Yetka | F01D 5/143 415/199.5 |
| 6,554,569 | B2 * | 4/2003 | Decker | F01D 5/141 415/192 |
| 7,811,050 | B2 * | 10/2010 | Roth | 415/58.5 |
| 7,967,556 | B2 | 6/2011 | Guemmer | |

* cited by examiner

AXIAL COMPRESSOR FOR FLUID-FLOW MACHINES

CROSS-REFERENCE TO PRIOR APPLICATION

Priority is claimed to Swiss Patent Application No. CH 01833/11, filed on Nov. 16, 2011, the entire disclosure of which is hereby incorporated by reference herein.

FIELD

The invention relates to an axial compressor for a fluid-flow machine, particularly a gas turbine.

BACKGROUND

Gas turbines and comparable fluid-flow machines as a rule comprise axial compressors in order to make available a compressed-air flow for a combustion process. Compared with other compressor types, axial compressors are characterized by a high efficiency, wherein on the pressure side of the compressor, high pressures can be achieved when the axial compressor has a sufficient multiplicity of compressor stages. However, the design effort when increasing the number of compressor stages increases greatly. The aim therefore is to make possible a high pressure on the pressure side of the compressor even with a comparatively low number of stages. This is synonymous to each compressor stage having to be able to generate or maintain a comparatively large pressure differential between suction and pressure side of the respective compressor stage. With today's axial compressors, this is guaranteed with high reliability.

At the same time it remains difficult to guarantee a stable operating behaviour under changing operating conditions. There is always the risk of a compressor stall, particularly on the suction side of the rotor blades. In such an event, the mass flow of the fluid to be compressed generated by the axial compressor suddenly drops, wherein in the worst case even a back stroke of the fluid to be compressed can occur.

For this reason, a large stability range of the compressor stages is regularly aimed at when designing an axial compressor.

SUMMARY

In an embodiment, the present invention provides an axial compressor of a fluid-flow machine. A flow path is disposed between a rotor shaft and a relatively stationary housing wall and extends in an axial direction of the rotor shaft concentrically with the rotor shaft and the housing wall. A plurality of compressor stages are axially arranged in sequence along the flow path in the axial direction. Each of the compressor stages includes at least one rotor blades row and a guide vane row disposed after the at least one rotor blades row in the axial direction. Each of the rotor blades rows includes rotor blades disposed next to one another on the rotor shaft in a circumferential direction and each of the guide vane rows includes guide vanes disposed on the housing wall next to one another in the circumferential direction. The flow path and the compressor stages operating therein are penetrable by a mass flow of a fluid to be compressed in a flow direction during operation of the compressor. A return is configured to return a part of the mass flow from a compressor discharge.

BRIEF DESCRIPTION OF THE DRAWINGS

The present invention will be described in even greater detail below based on the exemplary figures, wherein same reference characters refer to same or functionally similar components. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
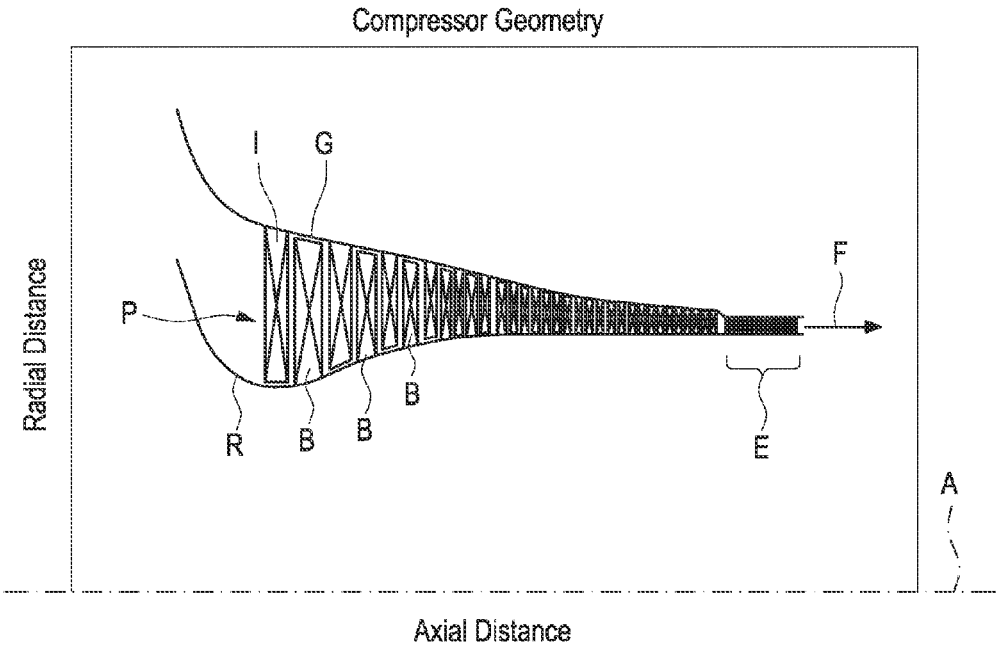
FIG. 1 a schematic sectional view of an axial compressor according to the invention, FIG. 2 an enlarged representation of the in flow direction rear third of the flow path corresponding to FIG. 1 and FIG. 3 an axial section of an axial compressor in design representation.

In an embodiment, the present invention increases the stability range of an axial compressor at very high pressure ratios, particularly in the part-load range (at closed VGV=Variable Guide Vanes) and/or with cold ambient temperature and/or cold engine.

According to an embodiment of the invention, an axial compressor provides a return (re-cycling) of a part of the mass flow of the fluid to be compressed, wherein in particular fluid from an outlet region behind the last stage of the compressor can be fed to an inlet or guide vanes suction side of one or more intermediate compressor stage(s) in the flow path in flow direction.

An embodiment of the invention is based on the general idea of expanding the stability range in the flow path last compressor stages by increasing the mass flow that occurs there. Because of this, the risk of a compressor stall on the suction sides of the last compressor stages is clearly reduced, and it is guaranteed that the last compressor stages work operationally safe even with difficult operating conditions of the axial compressor, for example with very low ambient temperature and/or during engine warm-up with the concomitant expansion of the gap widths between the radial ends of the rotor blades/vanes and the housing/rotor walls enclosing the flow path. At the same time it is guaranteed that the front compressor stages only have to work against a comparatively low backpressure and their operational safety is likewise stabilised.

According to the embodiments of the invention:

- the return comprises blow-in nozzles or means via which the returned mass part flow can be returned into the flow path in flow direction immediately adjacent to the housing wall and/or through channels on the vanes, close to the rotor wall and/or at intermediate radial positions;
- the return is conducted via one or more intermediate stages in the compressor, preferable three to six compressor stages before the last stages;
- within an end group of the compressor stages a substantially constant diameter of the rotor shaft is provided, and a radial spacing measured between the rotor circumference and the housing wall concentric thereto decreases by approximately 2-3% based on the radial spacing on the front most compressor stage of the end group;
- the return is provided between the pressure or outlet side of the last compressor stage of the end group and the inlet or suction side of an intermediate compressor stage of this end group;

in the return a control and/or shut-off valve arrangement is arranged the return is designed for a mass part flow the dimension of which corresponds to approximately 0.5%-10%, preferentially 2% of the total mass flow of the compressed fluid that occurs behind the last compressor stage;

a spacing space extending in axial direction of the rotor is provided between an end group of the compressor stages and preceding compressor stages in the flow path, within which space the cross section of the flow path decreases;

the cross section of the flow path decreases by approximately 50-80%;

on the suction side of the first compressor stage, i.e. on the suction side of the in flow direction front most blades of the compressor, adjustable guide vanes are arranged;

at least the first compressor stage is designed as transonic compressor stage.

A particular advantage of an embodiment of the invention lies in that the design effort for the return provided according to an embodiment of the invention is low. Merely return lines have to be substantially provided, the inlet openings of which must be arranged behind the last stage and the outlets of which must be arranged in intermediate compressor stages, for example in the form of slit-shaped nozzles lead to the suction side of compressor guide vanes arranged before the last compressor stages. Through suitable selection of the cross section of the orifice nozzles it can be guaranteed that the returned part of the mass flow reduces the overall efficiency of the axial compressor only to an acceptable degree.

Here is utilised the advantage that the stability range of the end stages of the axial compressor is significantly increased even at a stage when only a small component of the mass flow generated by the end stages is returned. Tests have shown that a return dimension of 2% of the mass flow generated by the last compressor stages leads to a substantial increase of the operation stability of the axial compressor.

It has proved advantageous in this connection when the nozzles of the return lines are designed in such a manner that a thin flow layer with high dynamic energy is generated on the housing wall limiting the flow path.

Although it is advantageous and adequate with regard to design simplicity an adequate increase of the stability of the compressor operation when the return is substantially employed only for generating a flow layer close to the wall in the region of the housing wall. However, it is possible in principle to blow the returned part of the mass flow into the flow path even close to the rotor shaft when, for example the return lines connect to corresponding channels in the stationary guide vanes and the blow-out nozzles for the returned fluid flow are arranged on the ends of the guide vanes on the rotor shaft side.

Since in principle the nozzles can be arranged in any positions of the guide vanes the returned part flow in principle can be introduced into the flow path in any positions between housing and rotor shaft.

In a further advantageous configuration of an embodiment of the invention it can be provided to arrange return lines that can be shut off, so that the return can be optionally switched on or switched off, wherein the return is preferentially only switched on in the case of special operating phases, for example at very cold ambient conditions, with closed VGV and cold engine. However, in "normal operation", a return can be omitted.

To this end, shut-off valves can be provided in the return lines, i.e. the design effort for the shut-off is comparatively low.

If applicable, valves that can be controlled also with respect to their opening cross section can be provided in order to be able to suitably control the returned mass flow.

Figure 2:
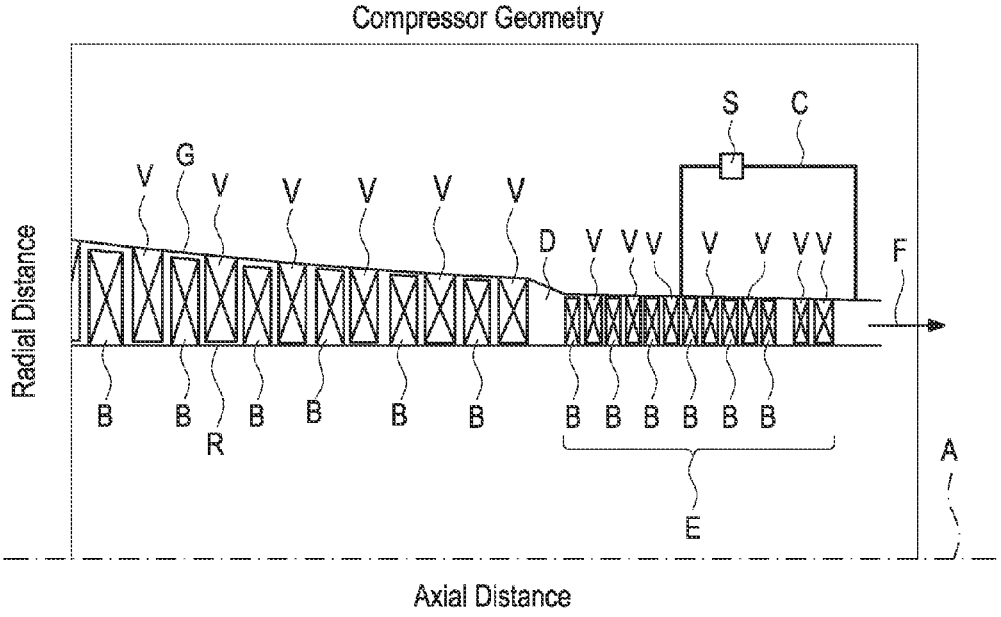

In the FIGS. 1 and 2, A in each case designates the axis of a rotor of an axial compressor. The line R shows the course or the shape of the outer circumference of the rotor shaft and G the course or the shape of a housing wall enclosing the rotor shaft with radial spacing. Accordingly, the annular space remaining between the outer circumference R of the rotor shaft and the housing wall G forms a flow path P narrowing in flow direction F of the fluid to be compressed, within which in fundamentally known manner rotor blades B on the rotor side and guide vanes V on the housing side are each arranged next to one another in rows in circumferential direction of the rotor axis A. Some vanes can be variable, so that there is the possibility to control the flow direction of the air sucked in by the axial compressor and to change the opening cross section available for the gas.

These controllable vanes are also called "variable guide vanes (VGV)".

The first controllable vane is also called "variable inlet guide vane (VIGV)".

On the flow path P between rotor circumference R and housing wall G the gas to be compressed is moved in flow direction F and in the process increasingly compressed by the compressor stages each comprising a row of rotor blades B and at least one row of vanes V. In the specific example, in the process, the compressed gas enters a spacing space D in flow direction F (where a constant extraction is done for turbine cooling purposes) and reaches the end compressor stages, which forms a group E.

The end of the compressor is equipped with a return C for compressed fluid, i.e. a single or a plurality of return lines branch off the flow path P behind the last compressor stage and lead to nozzle-like orifices before or in front of the suction side of an intermediate compressor stage. Preferentially, the return C is provided with a shut-off arrangement and/or control valve arrangement S, so that the returned quantity of pressure fluid can be controlled or the return C shut off.

The return C is preferentially dimensioned so that for example 2% of the mass flow of the generator pressure fluid present on the outlet side of the last compressor stage can be returned.

Thus, the permissible maximum pressure behind the last compressor stage can be increased by approximately 5% without having to fear a compressor stall on the compressor stages, particularly the last compressor stages.

Figure 3:
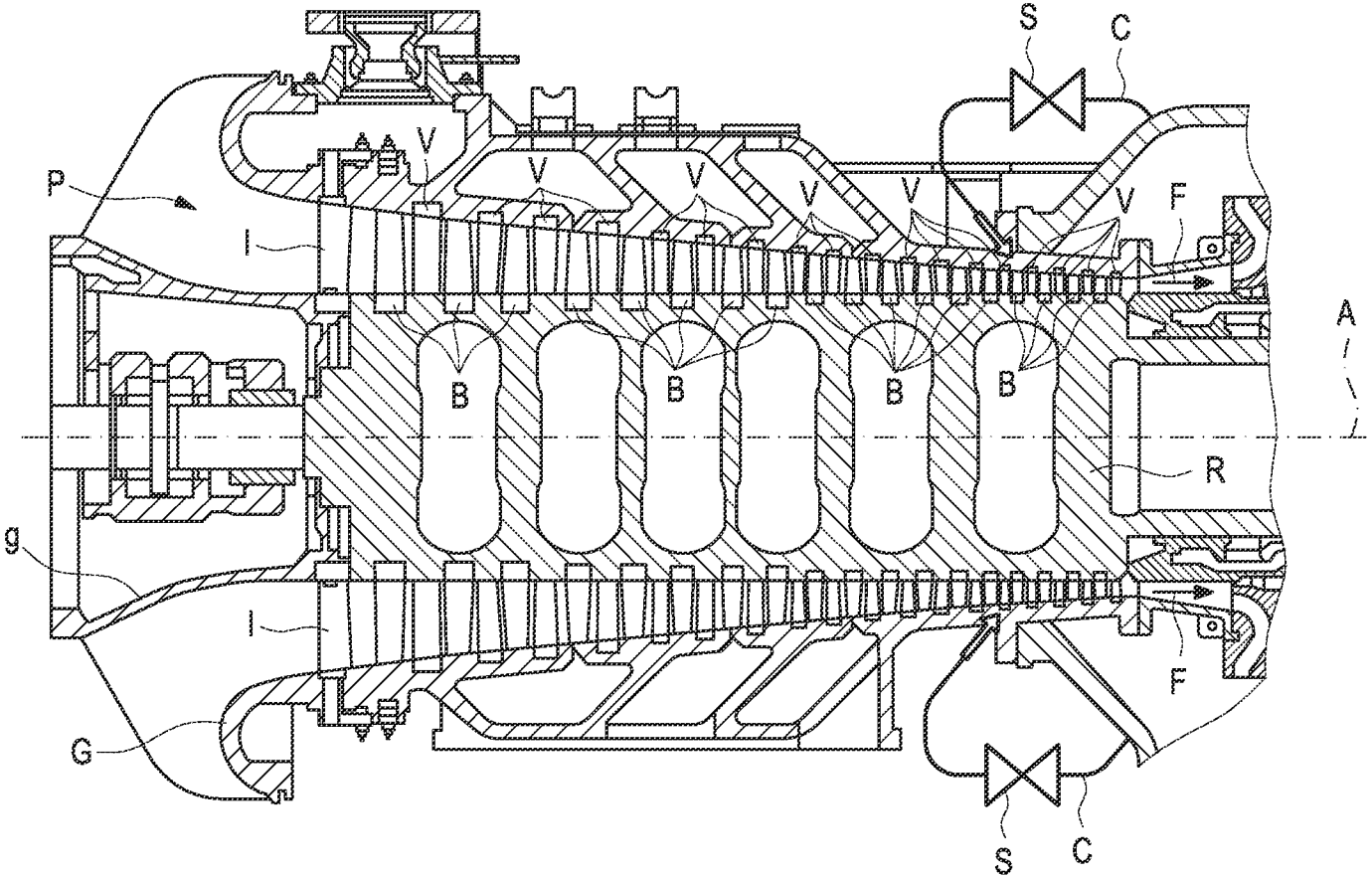

FIG. 3 shows a sectional view of an axial compressor corresponding to FIG. 1 in design representation. Deviating from FIG. 1, no spacing space D is provided with the embodiment of FIG. 3 between a last group E of compressor stages and compressor stages arranged in front thereof.

The return C or its return lines branch off a transition space to a turbine which is not shown and lead to orifices, which in the example shown are arranged in front of or on the suction side of the guide vanes before the fifth compressor stage from the last. A valve arrangement S is again provided in order to be able to shut off or control the return.

In addition to this it is evident in FIG. 3 that adjustable guide vanes I can be mounted in front of the first compressor stage(s) with respect to the axis A of the rotor R on a radially inner housing wall g, the conical shape of which steplessly continues the outer circumference of the rotor R.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B." Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise.

LIST OF REFERENCE CHARACTERS

A Axis of the rotor
R Outer circumference of the rotor shaft
G Housing wall
F Flow direction
P Flow path
B Rotor blades
V Guide vanes
D Spacing space
J Adjustable vanes on the inlet side
E End group of the compressor stages
C Return (Re-cycling)
S Valve arrangement
G Housing wall

What is claimed is:

1. An axial compressor of a fluid-flow machine, comprising:

a flow path disposed between a rotor shaft and a relatively stationary housing wall, the flow path extending in an axial direction of the rotor shaft concentrically with the rotor shaft and the housing wall;

a plurality of compressor stages axially arranged in sequence along the flow path in the axial direction, wherein the plurality of compressor stages includes more than six compressor stages and a last compressor stage, wherein no compressor stages are provided downstream of the last compressor stage, each of the plurality of compressor stages including at least one rotor blades row and a guide vane row disposed after each of the at least one rotor blades row in the axial direction of the flow path, each of the rotor blades rows including rotor blades disposed next to one another on the rotor shaft in a circumferential direction, two additional consecutive guide vane rows are downstream of the last compressor stage, each of the guide vane rows and the two additional consecutive guide vane rows including guide vanes disposed on the housing wall next to one another in the circumferential direction, the flow path and the plurality of compressor stages operating therein being penetrable by a mass flow of a fluid to be compressed in a flow direction during operation of the compressor; and a return configured to return a part of the mass flow from a compressor discharge, wherein an outlet region of the compressor is located downstream of the last compressor stage, the outlet region contains the two additional consecutive guide vane rows and the return, the return is downstream of the two additional consecutive guide vane rows, and the return is configured to return fluid from the outlet region to the flow path at a guide vane suction side of at least one intermediate compressor stage of the plurality of compressor stages, and wherein the at least one intermediate compressor stage is disposed at between three and six compressor stages before the last compressor stage in the axial direction.

2. The axial compressor according to claim 1, wherein the axial compressor is part of a gas turbine.

3. The axial compressor according to claim 1, wherein the return includes blow-in nozzles or one or more return lines that return the part of the mass flow to the flow path in the flow direction disposed at at least one of: immediately adjacent to the housing wall, through channels on the guide vanes, close to a wall of the rotor, and at intermediate radial positions.

4. The axial compressor according to claim 1, wherein the rotor shaft has a substantially constant diameter within an end group of the plurality of compressor stages in the axial direction such that a radial spacing between an outer circumference of the rotor shaft and the housing wall decreases by 2% to 3% from a front-most compressor stage of the end group.

5. The axial compressor according to claim 4, wherein the return is disposed between a pressure or outlet side of a last compressor stage of the end group and an inlet or suction side of an intermediate compressor stage of the end group.

6. The axial compressor according to claim 1, wherein at least one of a control and shut-off valve arrangement is disposed in the return.

7. The axial compressor according to claim 1, wherein the return is configured to return the part of the mass flow which is between 0.5% to 10% of a total mass flow occurring behind the last compressor stage.

8. The axial compressor according to claim 7, wherein the return is configured to return the part of the mass flow which is 2% of a total mass flow occurring behind the last compressor stage in the flow direction.

9. The axial compressor according to claim 1, wherein, in the axial direction, a spacing space is disposed between an end group of the plurality of compressor stages and preceding ones of the plurality of compressor stages, a cross section of the spacing space decreasing along the entire length of the spacing space in the flow direction.

10. The axial compressor according to claim 9, wherein the cross section of the flow path decreases by 50% to 80% within the spacing space.

11. The axial compressor according to claim 1, further comprising adjustable guide vanes disposed on a suction side of a first one of the plurality of compressor stages in the flow direction.

12. The axial compressor according to claim 1, wherein at least a first one of the plurality of compressor stages in the flow direction is configured as a transonic compressor stage.

13. An axial compressor of a fluid-flow machine, comprising:

a flow path disposed between a rotor shaft and a relatively stationary housing wall, the flow path extending in an axial direction of the rotor shaft concentrically with the rotor shaft and the housing wall;

a plurality of compressor stages axially arranged in sequence along the flow path in the axial direction, the plurality of compressor stages includes a last compressor stage and no compressor stages are provided downstream of the last compressor stage, each of the plurality of compressor stages including at least one rotor blades row and a guide vane row disposed after each of the at least one rotor blades row in the axial direction of the flow path, each of the rotor blades rows including rotor blades disposed next to one another on the rotor shaft in a circumferential direction, two additional consecutive guide vane rows are downstream of the last compressor stage, each of the guide vane rows and each of the two additional consecutive guide vane rows including guide vanes disposed on the housing wall next to one another in the circumferential direction, the flow path and the plurality of compressor stages operating therein being penetrable by a mass flow of a fluid to be compressed in a flow direction during operation of the compressor; and a return configured to return a part of the mass flow from a compressor discharge, wherein an outlet region of the compressor is located downstream of the last compressor stage, the outlet region contains the two additional consecutive guide vane rows and the return, the return is downstream of the two additional consecutive guide vane rows, and the return is configured to return fluid from the outlet region to the flow path at a guide vane suction side of at least one intermediate compressor stage, and wherein, in the axial direction, a spacing space is disposed between an end group of the plurality of compressor stages and preceding ones of the plurality of compressor stages, a cross section of the flow path decreasing within the spacing space in the flow direction.

14. An axial compressor of a fluid-flow machine, comprising:

a flow path disposed between a rotor shaft and a relatively stationary housing wall, the flow path extending in an axial direction of the rotor shaft concentrically with the rotor shaft and the housing wall;

a plurality of compressor stages axially arranged in sequence along the flow path in the axial direction, the plurality of compressor stages includes a last compressor stage and no compressor stages are provided downstream of the last compressor stage, each of the plurality of compressor stages including at least one rotor blades row and a guide vane row disposed after each of the at least one rotor blades row in the axial direction of the flow path, each of the rotor blades rows including rotor blades disposed next to one another on the rotor shaft in a circumferential direction, two additional consecutive guide vane rows are downstream of the last compressor stage, each of the guide vane rows and each of the two additional consecutive guide vane rows including guide vanes disposed on the housing wall next to one another in the circumferential direction, the flow path and the plurality of compressor stages operating therein being penetrable by a mass flow of a fluid to be compressed in a flow direction during operation of the compressor; and a return configured to return a part of the mass flow from a compressor discharge, wherein an outlet region of the compressor is located downstream of the last compressor stage, the outlet region contains the two additional consecutive guide vane rows and the return, the return is downstream of the two additional consecutive guide vane rows, and the return is configured to return fluid from the outlet region to the flow path at a guide vane suction side of at least one intermediate compressor stage.

* * * * *